US010925337B2

(12) United States Patent
McCarty et al.

(10) Patent No.: US 10,925,337 B2
(45) Date of Patent: Feb. 23, 2021

(54) CONCEALED RETRACTABLE POCKET DEVICE IN CLOTHING

(71) Applicants: Nicholas J. McCarty, Naples, FL (US); Thomas P. McCarty, Charleston, WV (US); Aaron T. Collie, Washington, WV (US); Kevin M. Truby, Pleasant Ridge, MI (US); Johannes Lopez, Naples, FL (US); Leta McCarty, Vienna, WV (US)

(72) Inventors: Nicholas J. McCarty, Naples, FL (US); Thomas P. McCarty, Charleston, WV (US); Aaron T. Collie, Washington, WV (US); Kevin M. Truby, Pleasant Ridge, MI (US); Johannes Lopez, Naples, FL (US); Leta McCarty, Vienna, WV (US)

(73) Assignee: STYLE INNOVATION COMPANY, LLC, Naples, FL (US)

( * ) Notice: Subject to any disclaimer, the term of this patent is extended or adjusted under 35 U.S.C. 154(b) by 0 days.

(21) Appl. No.: 16/215,766

(22) Filed: Dec. 11, 2018

(65) Prior Publication Data

US 2020/0146377 A1 May 14, 2020

Related U.S. Application Data

(60) Provisional application No. 62/598,185, filed on Dec. 13, 2017.

(51) Int. Cl.
*A41D 27/20* (2006.01)
*A41D 1/06* (2006.01)
(Continued)

(52) U.S. Cl.
CPC ..... *A41D 27/20* (2013.01); *A41D 1/06* (2013.01); *A41D 27/201* (2013.01); *A45F 3/04* (2013.01);
(Continued)

(58) Field of Classification Search
CPC . A41D 1/06; A41D 1/08–1/089; A41D 27/20; A41D 27/201; A41D 27/207;
(Continued)

(56) References Cited

U.S. PATENT DOCUMENTS 1,506,255 A * 8/1924 Rosenstein ..... A41F 9/025 2/236
3,042,932 A * 7/1962 Eppy ..... A41F 9/00 2/236
(Continued)

FOREIGN PATENT DOCUMENTS

CN 202311345 B1 7/2012

*Primary Examiner* — Amy Vanatta
(74) *Attorney, Agent, or Firm* — Spilman Thomas & Battle PLLC; William P. Smith

(57) ABSTRACT

A corrosion resistant retractable tool or opener device is provided. The retractable tool is integrated within an article of clothing. The integrated retractable tool includes a retractor having a housing that encloses an internal spring coil connected to a retractable cord for drawing the cord into the retractor. The cord is attachable to the retractable tool located at a first end of retractable tool. Retractable tool has a second aperture opposite the retractor end and a flange portion projects into the second aperture to provide a lever for urging a bottle cap from a top bead around a bottle. Retractor is fixedly attached, e.g., by stitching or adhesive means, within a sleeve portion integral with a seam, waistband, hemline or pocket of an article of clothing. The strap overlap sleeve portion encloses the retractable tool to conceal the retractable tool.

8 Claims, 4 Drawing Sheets

(51) Int. Cl.

| | |
|---|---|
| ***B67B 7/16*** | (2006.01) |
| ***A45F 5/02*** | (2006.01) |
| ***A45F 3/04*** | (2006.01) |
| *A45F 3/00* | (2006.01) |
| *A63B 57/50* | (2015.01) |
| *B26B 11/00* | (2006.01) |

(52) U.S. Cl.
CPC ..... *A45F 5/022* (2013.01); *B67B 7/16* (2013.01); *A45F 2003/003* (2013.01); *A63B 57/50* (2015.10); *B26B 11/001* (2013.01)

(58) Field of Classification Search
CPC .. A41D 13/0012; A41D 2200/10; B67B 7/16; A41F 9/00; A41F 9/002; A63B 2210/58; A63B 57/00; A63B 57/353; B26B 11/001; B26B 11/00; B26B 11/006; A45F 2003/003; A45F 2200/0575; A45F 5/02; A45F 5/021; A45F 5/022; A45F 2200/05; A45F 5/004; A45F 2005/006; A45F 2005/023
USPC ..... 2/227, 236, 238
See application file for complete search history.

(56) References Cited

U.S. PATENT DOCUMENTS

| | | | | |
|---|---|---|---|---|
| 5,682,981 | A | 11/1997 | Sudborough | |
| 5,782,708 | A | 7/1998 | Kimball, Jr. | |
| 6,185,772 | B1 | 2/2001 | Bates | |
| D474,713 | S | 5/2003 | Eddy | |
| D555,447 | S * | 11/2007 | Bhavnani | A41F 9/00 D8/34 |
| 7,484,249 | B1 * | 2/2009 | Reese | A41D 13/04 2/48 |
| D622,178 | S | 8/2010 | Kelleghan | |
| 8,549,667 | B1 | 10/2013 | Fuller | |
| 8,925,423 | B1 | 1/2015 | Rotolo | |
| D729,057 | S | 5/2015 | She et al. | |
| 9,021,615 | B2 * | 5/2015 | Cockram | A41D 13/0015 2/236 |
| D792,057 | S * | 7/2017 | Krocheski | A42B 1/241 D2/731 |
| 2005/0039242 | A1 * | 2/2005 | Edmondson | A42B 1/241 2/207 |
| 2007/0266477 | A1 * | 11/2007 | Cunliffe | A42B 1/241 2/209.13 |
| 2011/0179545 | A1 | 7/2011 | Rummel | |
| 2014/0216209 | A1 * | 8/2014 | Shrock | B67B 7/16 81/3.25 |
| 2017/0265544 | A1 * | 9/2017 | Allouche | A41D 27/201 |

* cited by examiner

CONCEALED RETRACTABLE POCKET DEVICE IN CLOTHING

CROSS-REFERENCE TO RELATED APPLICATIONS

This patent application claims the benefit of and priority to U.S. Provisional Patent Application Ser. No. 62/598,185 filed Dec. 13, 2017, entitled "CONCEALED CORROSION RESISTANT RETRACTABLE POCKET TOOL IN CLOTHING", which his hereby incorporated by reference in its entirety.

BACKGROUND OF THE INVENTION

The application generally relates to a concealed, corrosion resistant, retractable device integrated into an article of clothing. The application relates more specifically to a concealed corrosion resistant retractable tool such as a can & bottle opener or other tool which becomes an integral component of an article of clothing, such as the waistband or vertical seam or hemline of a pair of shorts, pants, swim trunks, jeans, belts, tool belts, shirts, jackets, server aprons, backpacks, etc.

An opener is a device that enables the removal of bottle caps from bottles, or pierces a can. The opener may also include corkscrews used to remove stoppers from, e.g., wine bottles. The opener is necessary due to the crimp fit that a bottle cap has when applied to the bottle.

Bottle openers may be transported easily, but in most instances are not suitable to be conveniently stored in a place that is easily accessible. This can be very problematic for people in restaurants, bars, sporting events and leisure activities, who may need to store an opener in their pocket or in a waistband of their clothing or at another location in the immediate vicinity that makes quick and efficient access difficult.

In some examples, wearable bottle openers may be incorporated onto a garment, e.g., a glove, flip flop, hat, key ring or a piece of jewelry, e.g., a watch or ring. They are mostly placed fixed in position on the user such that a user does not have the ability to conceal it from the viewing public, if desired. Many of the wearable bottle openers are positioned, e.g., on the user's fingers or on the bottom of a flip flop, making it difficult to manipulate over a cap of a bottle.

Some wearable bottle openers include a wristband with an attached member having a rounded opening. The wrist is a joint or articulation between the forearm and the hand. Wristbands are encircling strips worn on the wrist, made from a variety of materials depending on the purpose. A wrist band includes a length wound at least one turn around the wrist, and including pieces of wrist Velcro® attached at a predetermined position so as to press and fix the wrist in a state of being wound around the wrist. These wristbands provide similar disadvantages as those other known devices. For example, they are difficult to manipulate the rounded opening over a cap of a bottle, because it cannot be readily visualized by the user and/or the user is not accustomed to opening bottles utilizing only their wrists. Additionally, the exertion of continual force on the user's wrist by the bottles that are opened causes pain to many users and expedites degenerative failure of tissues and bones found in the wrist.

Still other examples include articles of clothing having hidden pockets wherein a bottle opener may be stored behind flaps or fasteners. Also, there are known retractable tools that may be clipped or pinned on a belt or jacket worn by the user.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

BRIEF SUMMARY OF THE INVENTION

One embodiment relates to a corrosion resistant retractable tool, such as a can & bottle opener device, integrated within an article of clothing. The integrated opener device includes a retractor having a housing that encloses an internal spring coil connected to a retractable cord for drawing the cord into the retractor. The cord is attachable to the opener device located at a first end of opener device. Opener device has a second aperture opposite the retractor end and a flange portion projects into the second aperture to provide a lever for urging a bottle cap from a top bead around a bottle. Retractor is fixedly attached, e.g., by stitching or adhesive means, within a sleeve portion integral with a seam or waistband of an article of clothing. An optional closure strap extends from a backing side of sleeve portion, the strap facing outwardly and foldable on to a top layer of sleeve portion to close the end of the sleeve portion. When the opener device is retracted to the stored position, the strap overlap sleeve portion encloses the opener device, thereby concealing opener device on a user's article of clothing.

Another embodiment relates to a corrosion resistant retractable tool includes a retractor portion. The retractor portion has a housing that encloses an internal spring coil. The internal spring coil is connected to a retractable cord for drawing the cord into and from the housing. The cord has an attachment portion connectable to the tool at a first aperture located at a first end of the tool. The retractor portion is fixedly attached within a sleeve portion sewn into an article of clothing. The sleeve portion includes a closure strap extending from a backing side of the sleeve portion. The closure strap facing outwardly and foldable on to a top layer of sleeve portion to close an end of the sleeve portion with the tool disposed therein.

Still another embodiment relates to a wearable article with an integrated tool includes a retractor portion. The retractor portion has a housing enclosing an internal spring coil. The internal spring coil is connected to a retractable cord for drawing the cord into and from the housing. The cord has an attachment portion connectable to a tool at a first aperture located at a first end of the tool. The retractor portion is fixedly attached within a sleeve portion of the wearable article. The sleeve portion includes a closure strap extending from a backing side of the sleeve portion. The closure strap faces outwardly and is foldable on to a top layer of sleeve portion to close an end of the sleeve portion with the tool disposed therein.

Another embodiment relates to a pair of shorts including a retractable tool, e.g., a bottle or can opener device as recited above, the retractable tool sewn into a waistband or a seam of the pair of shorts.

Another embodiment relates to a pair of pants, skirt, shirt, jacket or similar article of clothing, including a retractable tool as recited above, the retractable tool sewn into an internal surface of a pocket of the pair of pants.

Advantages include the ability to have access to a bottle opener or other retractable tool, when at a sporting event, picnic, camping, leisure location, or work setting and not forgetting to bring a convenience or necessary item.

Another advantage is providing a retractable tool where it is concealed and unobtrusive, yet easy to access, and provides protection from dropping the tool.

Still another advantage is a retractable tool that can be extended as needed and easily returned to the stored position in a waistband or seam of an article of clothing.

Another advantage is the quick storage & access of tools or devices by workers including police, military, and laborers who work at high elevations.

Alternative exemplary embodiments relate to other features and combinations of features as may be generally recited in the claims.

BRIEF DESCRIPTION OF DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
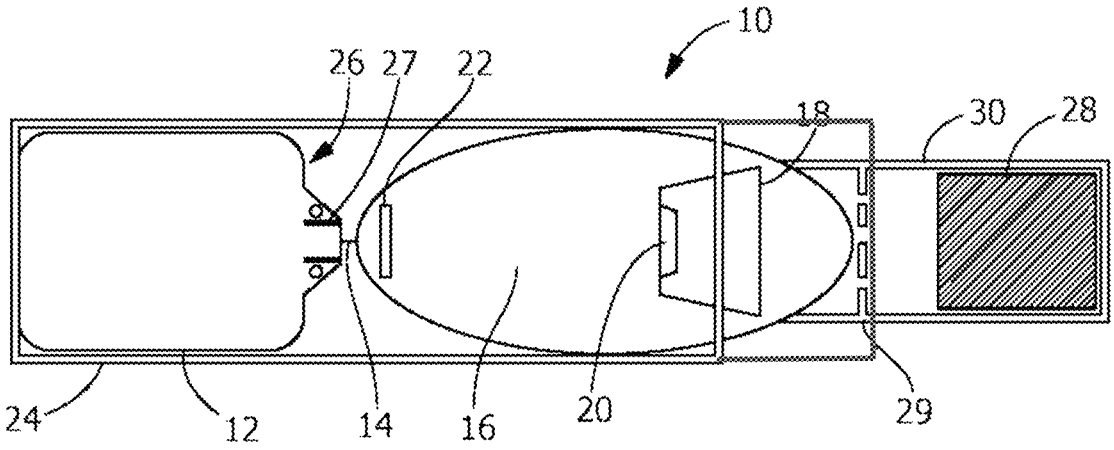
FIG. 1 shows a cross-sectional plan view of an exemplary embodiment of a corrosion resistant retractable can & bottle opener pocket device of the present invention.

Referring to FIG. 1, a corrosion resistant retractable tool, e.g., can & bottle opener pocket device 10 is shown. A retractor 12 has a housing 26 enclosing an internal spring coil 27 connected to a retractable cord 14 for drawing cord 14 into the housing 26 for storage when not in use. Cord 14 is attachable to a retractable tool, e.g., an opener device, 16 through aperture 22 located at a first end of retractable tool 16. Retractable tool 16 has a second aperture 18 at an opposing end from aperture 22. Aperture 18 is generally rectangular and a flange portion 20 projects into aperture 18 on one side. Flange portion 20 provides a lever for urging a bottle cap from a top bead around a bottle, as is well known. Retractable tool 16 may be any commonly known bottle opener or can opener, a golf divot tool (FIG. 10), a fishing tool, or similar devices, and is not limited to the exemplary embodiment of FIG. 1. Preferably retractable tool 16 and retractor 12 are substantially flat in profile to minimize any bulkiness that may cause the pocket device 10 to be cumbersome or unattractive when integrally placed on an article of clothing as described in greater detail below. Retractor 12 is fixedly attached, e.g., by stitching or adhesive means, within a sleeve portion 24 that is attachable to or integral with a seam or waistband of an article of clothing. Sleeve portion 24 is longer than the combined lengths of retractor 12 and retractable tool 16, to fully enclose retractable tool when in the retracted position. A closure strap 30 extends from a backing side of sleeve portion 24. A hook and loop, Velcro® or adhesive material patch 28 is disposed adjacent the end of strap 30 facing outwardly, and foldable at a fold line 29 on to a top layer of sleeve portion to close an open end of sleeve portion 24. Patch 28 interlocks or mates with a fabric of the sleeve portion or a surface adapted for adhering with or to the patch material, such as Velcro® or like materials. Thus, when the retractable tool 16 is retracted to the stored position, strap 30 may overlap sleeve portion 24 to enclose retractable tool 10 entirely, thereby concealing retractable tool in a user's article of clothing (see, e.g., FIGS. 2-12). In another embodiment sleeve portion may include a zipper for closing the sleeve portion. Closure strap is an optional feature. In alternate embodiments the tool may be concealed with or without a closure strap or zipper.

In an embodiment, retractor cord 14 may be approximately 24" (or longer or shorter depending on the application) Kevlar® retractable line, or any similar non-corrosive material, and the internal retractor spring may be formed of stainless steel to minimize any corrosion or oxidation from exposure to water or other elements. Housing 12 may be, e g., a black polycarbonate body and head, and opener may be constructed from, e.g., anodized aluminum, again as a preventive measure to minimize corrosive effects. Using non-corrosive material allows a user the option to wear the tool in corrosive environments like salt water, chlorinated areas, etc . . . and also to wash or flush the retractable tool with fresh water and damp dry following use, without removing the retractable device from the clothing, belt or backpack. Optionally, a flushing tube (not shown) may be provided to enable flushing of the internal space in sleeve portion 24, along with the flushing of the inside of the retractable device Additional features may be provided with or in place of bottle opener 16, e.g., carabiner, split keyring, ID badge holder, wine bottle opener, golf divot repair tool 54 (FIG. 10), fishing tool, or other suitable tools for attachment to a retractor.

Figure 2:
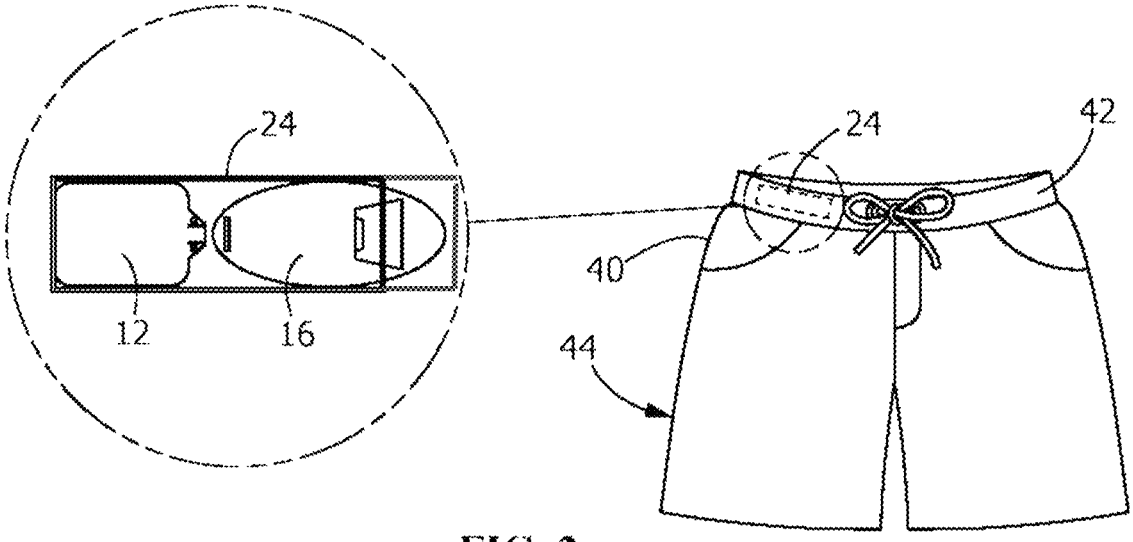
FIG. 2 shows an article of clothing having a waistband pocket that integrates the opener device of FIG. 1.

Referring next to FIG. 2, an article of clothing 40, e.g. a pair of short pants, is shown front 44 and rear 46. In the exemplary embodiment of FIG. 2, waistband 42 includes retractable tool 16 within sleeve portion 24. Sleeve portion 24 is integral with waistband 42, at front 44 of short pants 40.

Figure 3:
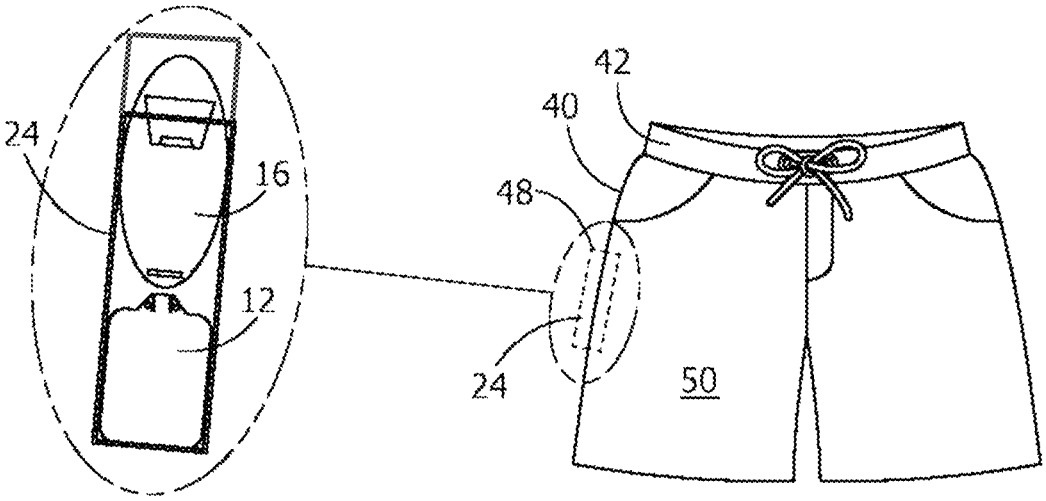
FIG. 3 shows an article of clothing wherein the opener device is integrated in a pocket within a seam.

Referring next to FIG. 3, another exemplary embodiment of the invention is shown wherein opener device 10 is integrated within a seam 48 of a pants leg 50, e.g., along the side of short pants 40.

Figure 4:
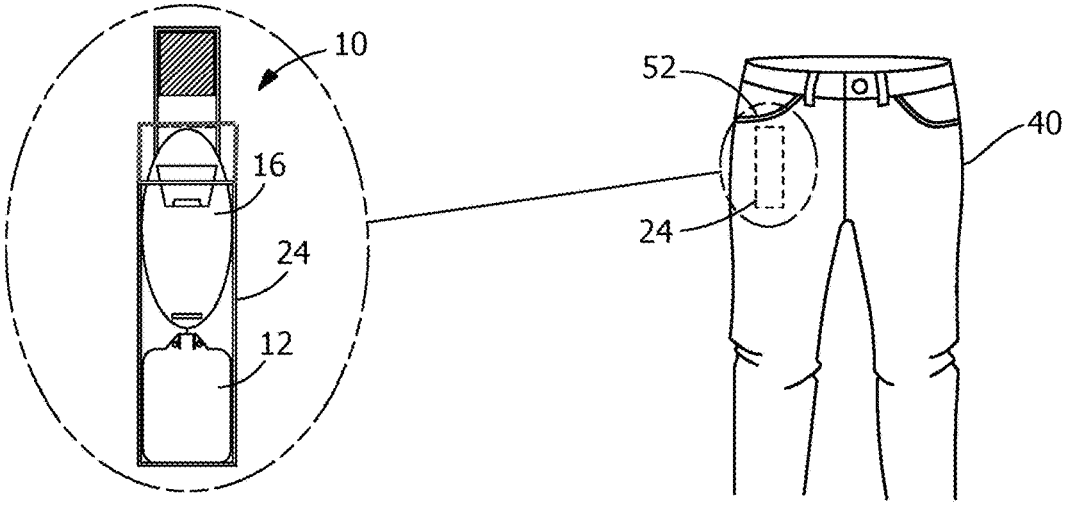
FIG. 4 shows the opener device permanently integrated within an article of clothing within a pocket.
Figure 5:
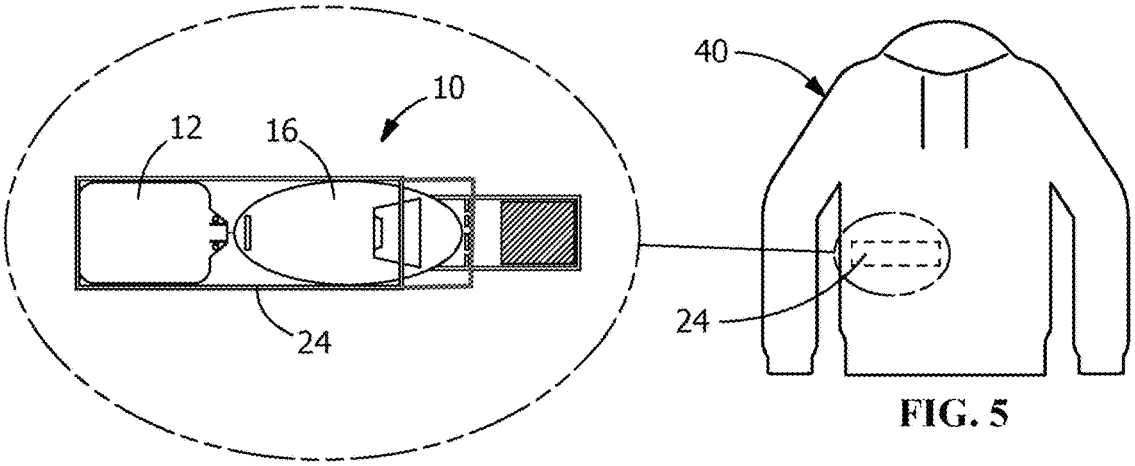
FIG. 5 shows the opener device integrated within a pocket of a jacket.
Figure 6:
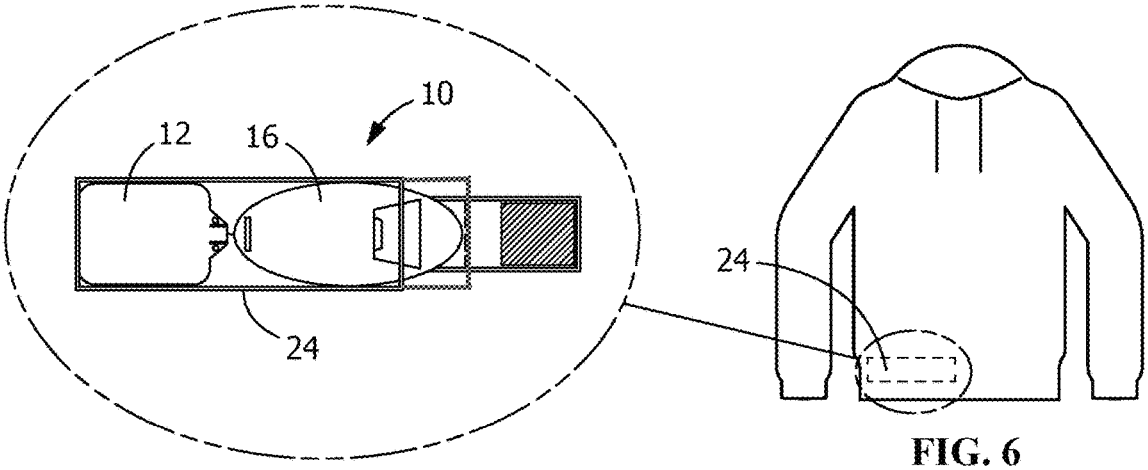
FIG. 6 shows the opener device integrated in a pocket within a shirt.

Referring next to FIG. 4, in still another exemplary embodiment of the invention, opener device 10 may be integrally stitched into or otherwise permanently integrated within article of clothing 40, e.g., jeans, within a pocket 52 of jeans 40.

Other embodiments of the invention in which a concealed, corrosion resistant, retractable tool becomes an integral component concealed in the waistband or in a vertical seam or hemline of an article of clothing, e.g., in a pair of shorts, pants, swim trunks, jeans, or a shirt, jacket or belt, are also contemplated within the scope and spirit of the invention as set forth herein and in the appended claims. E.g., FIGS. 5 and 6, respectively, show the opener device 16 integrated within a pocket of a jacket and within a shirt.

Figure 7:
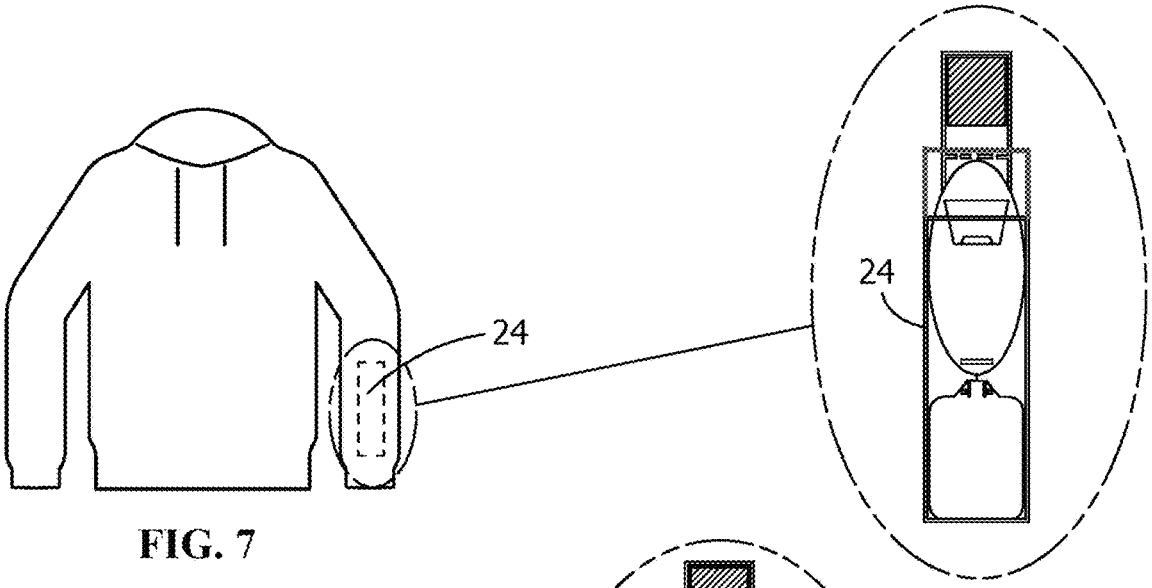
FIG. 7 shows the opener device integrated in a pocket within a sleeve.
Figure 8:
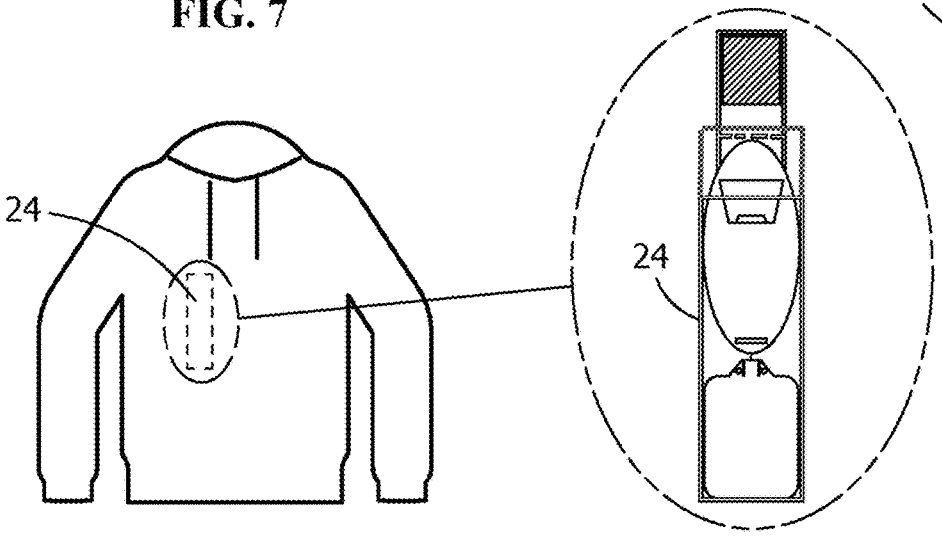
FIG. 8 shows the opener device integrated within a pocket in a jacket lining.
Figure 9:
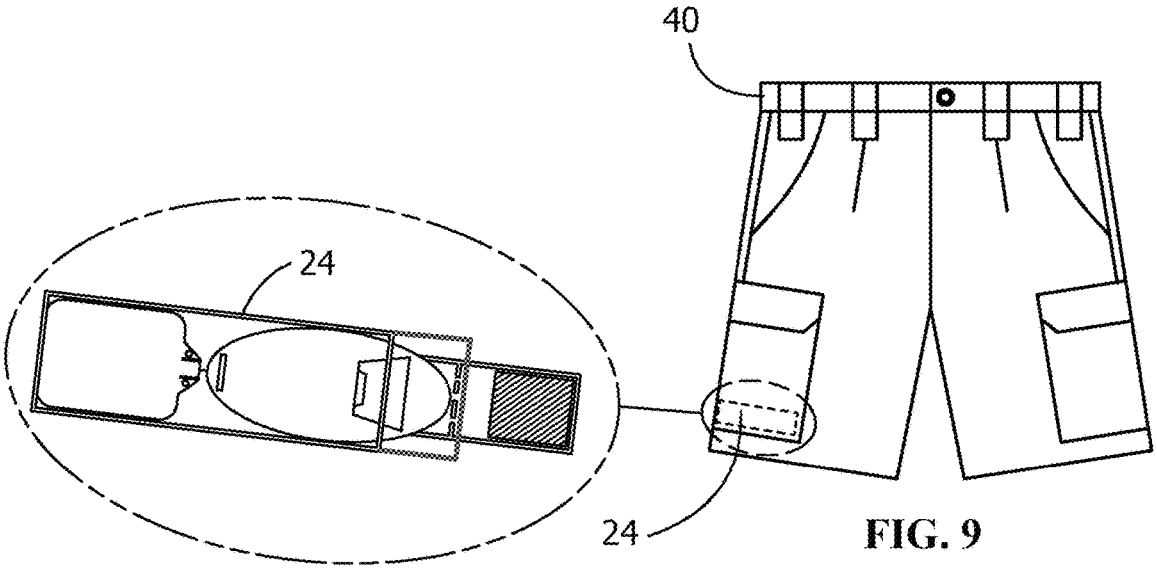
FIG. 9 shows the opener device integrated within a pocket of a pair of cargo shorts.
Figure 10:
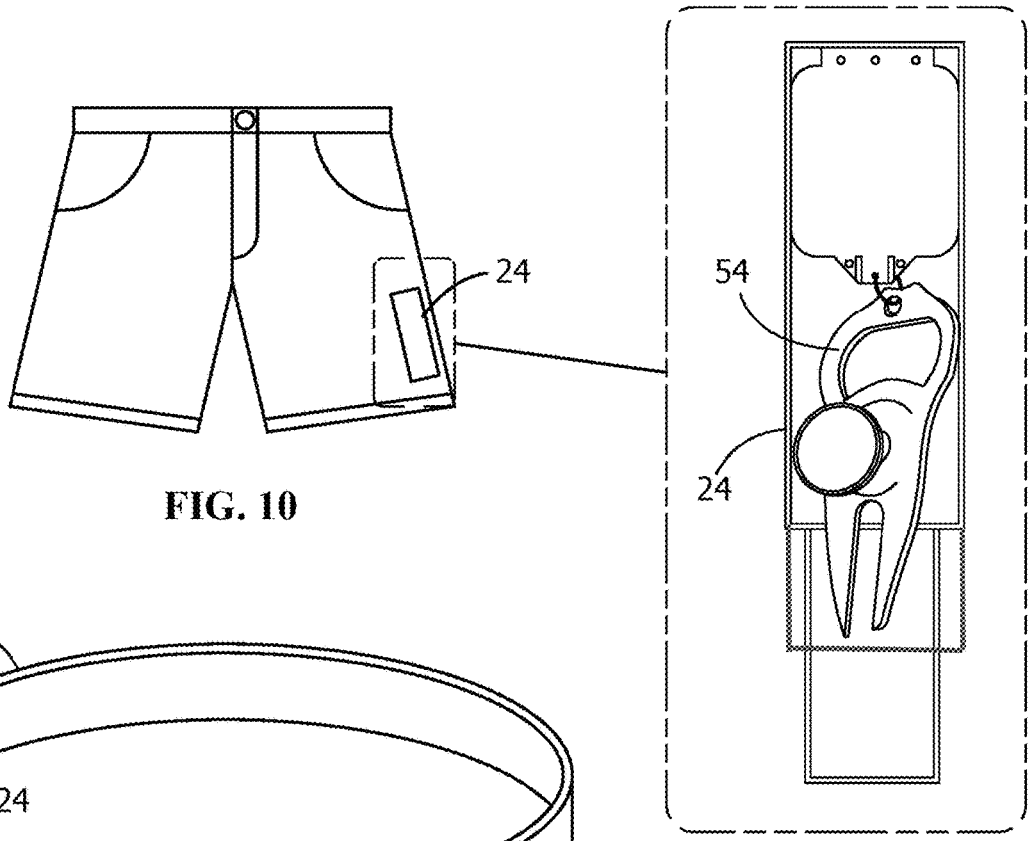
FIG. 10 shows a retractable golf divot repair tool 54 integrated in a pocket within a seam of a pair of golf shorts.

Additional exemplary embodiments are shown in FIGS. 7-10. FIG. 7 shows the opener device integrated within a sleeve. FIG. 8 shows the opener device integrated within a jacket lining. FIG. 9 shows the opener device integrated within a pocket of a pair of cargo shorts. FIG. 10 shows a retractable golf divot repair tool integrated within a seam of a pair of golf shorts.

Figure 11:
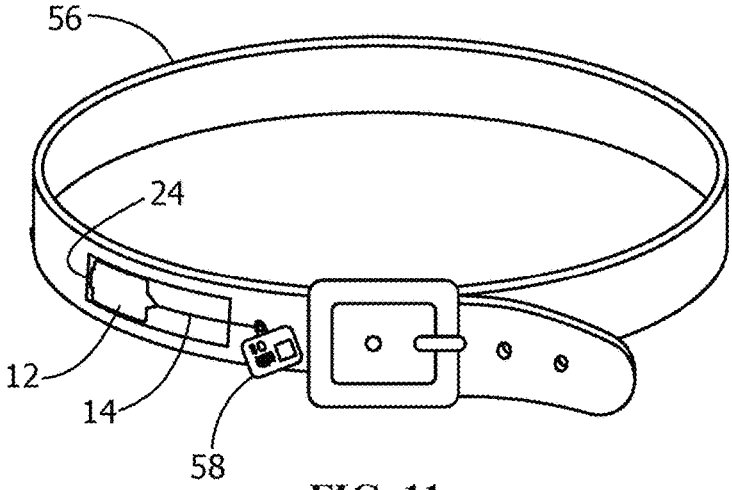
FIG. 11 shows a retractable ID badge tool integrated in a pocket within a belt.

Referring next to FIG. 11, a belt 54 is shown having an integrated sleeve 24 enclosing a retractor 12 attached to an identification, or ID, badge 58 via cord 14.

Figure 12:
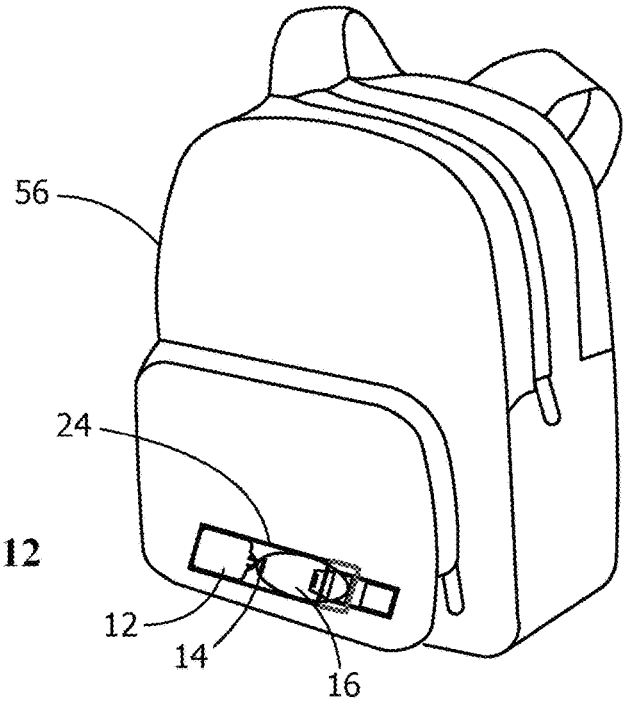
FIG. 12 shows a retractable opener device integrated in a pocket within a backpack.

Referring to FIG. 12, a backpack 60 is shown. Backpack 60 includes an integrated sleeve 24 enclosing a retractor 12 attached to an opener device 16 via cord 14.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. Alternate embodiments of the pocket device may include a golf divot tool, Swiss army knife, and similar tools to replace the can and bottle opener device that is integrally attached inside the article of clothing.

It is important to note that the construction and arrangement of the concealed, corrosion resistant, retractable tool as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A retractable opener device comprising:

a retractor portion having a housing that encloses an internal spring coil connected to a retractable cord for drawing the cord into and from the housing;

the cord having an attachment portion, the attachment portion is connected to an opener device at a first aperture located at a first end of the opener device;

the opener device having a second aperture opposite the first end and a flange portion projecting into the second aperture to provide a lever for urging a cap from a bottle; and the opener device having a substantially flat profile;

the retractor portion being fixedly attached within a sleeve portion; the sleeve portion being integral with a waistband of a pair of pants;

wherein the sleeve portion further comprises a closure strap extending from a backing side of the sleeve portion, the closure strap facing outwardly and foldable on to a top layer of the sleeve portion to close an end of the sleeve portion.

2. The device of claim 1, wherein the sleeve portion is integrated into the the waistband by stitching or adhesive.

3. The device of claim 1, wherein the retractor portion is fixedly attached by stitching within the sleeve portion that is integral with the waistband.

4. The device of claim 1, wherein when the opener device is retracted into the sleeve portion the closure strap overlaps the sleeve portion and encloses the opener device, thereby concealing the opener device in the waistband.

5. The device of claim 1, wherein the sleeve portion is longer than a combined length of the retractor portion and the opener device to fully enclose the opener device when in the retracted position.

6. The device of claim 1, wherein the closure strap extends from a backing side of the sleeve portion; and a patch having hook and loop or adhesive material being disposed adjacent an end of the closure strap;

the patch facing outwardly and foldable at a fold line on to a top layer of the sleeve portion to secure the closure strap to the sleeve portion.

7. A corrosion resistant retractable tool comprising:

a retractor portion having a housing that encloses an internal spring coil connected to a retractable cord for drawing the cord into and from the housing;

the cord having an attachment portion, the attachment portion connected to the tool at a first aperture located at a first end of the tool;

wherein the tool comprises a bottle opener having a substantially flat profile;

the retractor portion being fixedly attached within a sleeve portion sewn into a waistband of a pair of pants; and wherein the sleeve portion further comprises a closure strap extending from a backing side of the sleeve portion, the closure strap facing outwardly and foldable on to a top layer of the sleeve portion to close an end of the sleeve portion with the tool disposed therein.

8. The device of claim 7, wherein the closure strap extends from a backing side of the sleeve portion and a patch having hook and loop or adhesive material being disposed adjacent an end of the closure strap;

the patch facing outwardly and foldable at a fold line on to a top layer of the sleeve portion to secure the closure strap to the sleeve portion.

* * * * *